US005462828A

United States Patent [19]

Moffat et al.

[11] Patent Number: 5,462,828

[45] Date of Patent: Oct. 31, 1995

[54] STYRENE/N-BUTYL ACRYLATE TONER RESINS WITH EXCELLENT GLOSS AND FIX PROPERTIES

[75] Inventors: Karen A. Moffat, Brantford; Fatima M. Pontes; Anthony J. Paine, both of Mississauga; Brian McAneney, Burlington; Paul Puri, Brampton, all of Canada

[73] Assignee: Xerox Corporation, Stamford, Conn.

[21] Appl. No.: 264,210

[22] Filed: Jun. 22, 1994

[51] Int. Cl.[6] ..... G03G 9/087

[52] U.S. Cl. ..... 430/106; 430/109

[58] Field of Search ..... 430/106, 109, 430/110

[56] References Cited

U.S. PATENT DOCUMENTS

| | | | |
|---|---|---|---|
| 5,064,739 | 11/1991 | Asanae et al. | 430/122 |
| 5,102,764 | 4/1992 | Rossi et al. | 430/110 |
| 5,338,638 | 8/1994 | Tsuchiya et al. | 430/109 |
| 5,364,721 | 11/1994 | Asada et al. | 430/109 |

*Primary Examiner*—John Goodrow

*Attorney, Agent, or Firm*—Oliff & Berridge; Eugene Palazzo

[57] ABSTRACT

A toner composition includes a styrene/n-butyl acrylate copolymer resin having a number average molecular weight of less than about 5,000, a weight average molecular weight of from about 10,000 to about 40,000 and a molecular weight distribution of greater than 6 and provides excellent gloss and high fix properties at a low fusing temperature.

17 Claims, 1 Drawing Sheet

STYRENE/N-BUTYL ACRYLATE TONER RESINS WITH EXCELLENT GLOSS AND FIX PROPERTIES

BACKGROUND OF THE INVENTION

This invention relates to an improved resin composition and more particularly to an improved styrene/butyl acrylate resin composition useful for making electrostatographic toner compositions.

Styrene/n-butyl acrylate resins are known in the art.

For example, U.S. Pat. No. 5,102,764 discloses a styrene/n-butyl acrylate polymer resin with a magenta dye dispersed in the polymer resin. The resin is disclosed as having a glass transition temperature in the range of from about 40° C. to about 90° C. and a molecular weight range of 50,000 to 250,000. As a further example, U.S. Pat. No. 5,064,739 discloses a magnetic developer consisting of a magnetic carrier and a magnetic toner. The toner comprises, for example, a styrene/n-butyl acrylate copolymer with Mn=30,000 and Mw=200,000.

Styrene/n-butyl acrylate polymer toners of similar chemical composition to toners of the present invention are known. For example, Nippon Carbide manufactures a toner, identified as NCHT041C, which is 88% styrene and 12% n-butyl acrylate. The toner has molecular weight properties of Mn=3,336, Mw=19,776 and MWD=5.93 and a glass transition temperature of 65.8° C. Although the toner has good gloss properties, with gloss temperatures between 139° C. and 148° C., it has poor fix properties, with a fixing fusing temperature of 176° C. This emulsion/aggregation toner is included and analyzed as a Comparative Example, below.

Experimentation in the art of toner resin production has focused upon narrow molecular weight regions with narrow molecular weight distributions, as those two variables greatly affect the gloss and fix properties of the resins. In many cases a trade-off is necessary between the gloss and fix properties of the toner, and such a trade-off usually results in an increase in the fusing temperature (which is defined as the temperature at which the toner will fuse onto the paper to give the desired property). For example, a toner designed with high gloss properties often has poor fix behavior. Either the toner is too brittle and has poor mechanical properties or the particles are not well coalesced to each other and thus do not adhere well to the paper. In other cases, the fix properties of the toner may be very good, but only at the expense of the gloss properties. Efforts to improve both the gloss and the fix properties of toner resins have been undertaken, but have met minimal success.

As described herein, the gloss and fix properties of a styrene/n-butyl acrylate resin are both related to the molecular weight properties of the resin, but in an opposite manner. As the molecular weight increases, the fix properties of the resin increase proved the glass transition temperature (Tg) of the resin remains constant. In addition, the gloss properties of the resin decrease as the molecular weight increases. For this reason, it was believed within the toner/developer community that a styrene-acrylate based resin could never produce glossy images of the same level as conventional polyester-based toners. The resins of the present invention overcome this misconception.

SUMMARY OF THE INVENTION

A need continues to exist for improved toner resin compositions, particularly those which provide excellent gloss and high fix properties at a low fusing temperature. We have discovered that a toner resin with a low Mn and high MWD, as compared to conventional resins, provides such excellent gloss and high fix properties, while reducing the fusing temperature and glass transition temperature. Such an improved toner resin composition is provided in this invention.

Specifically, this invention provides a toner resin composition comprising a styrene/n-butyl acrylate copolymer resin composition wherein said resin has a number average molecular weight of less than about 5,000, a weight average molecular weight of from about 10,000 to about 40,000 and a molecular weight distribution of greater than 6.

The resin compositions of the present invention are particularly useful in toners for use in electrostatographic imaging systems. The resins of the present invention provide both high gloss properties and good fix properties while maintaining a low fusing temperature. These resins therefore provide much improvement over conventional toner resins.

DETAILED DESCRIPTION OF THE INVENTION

Figure 1:
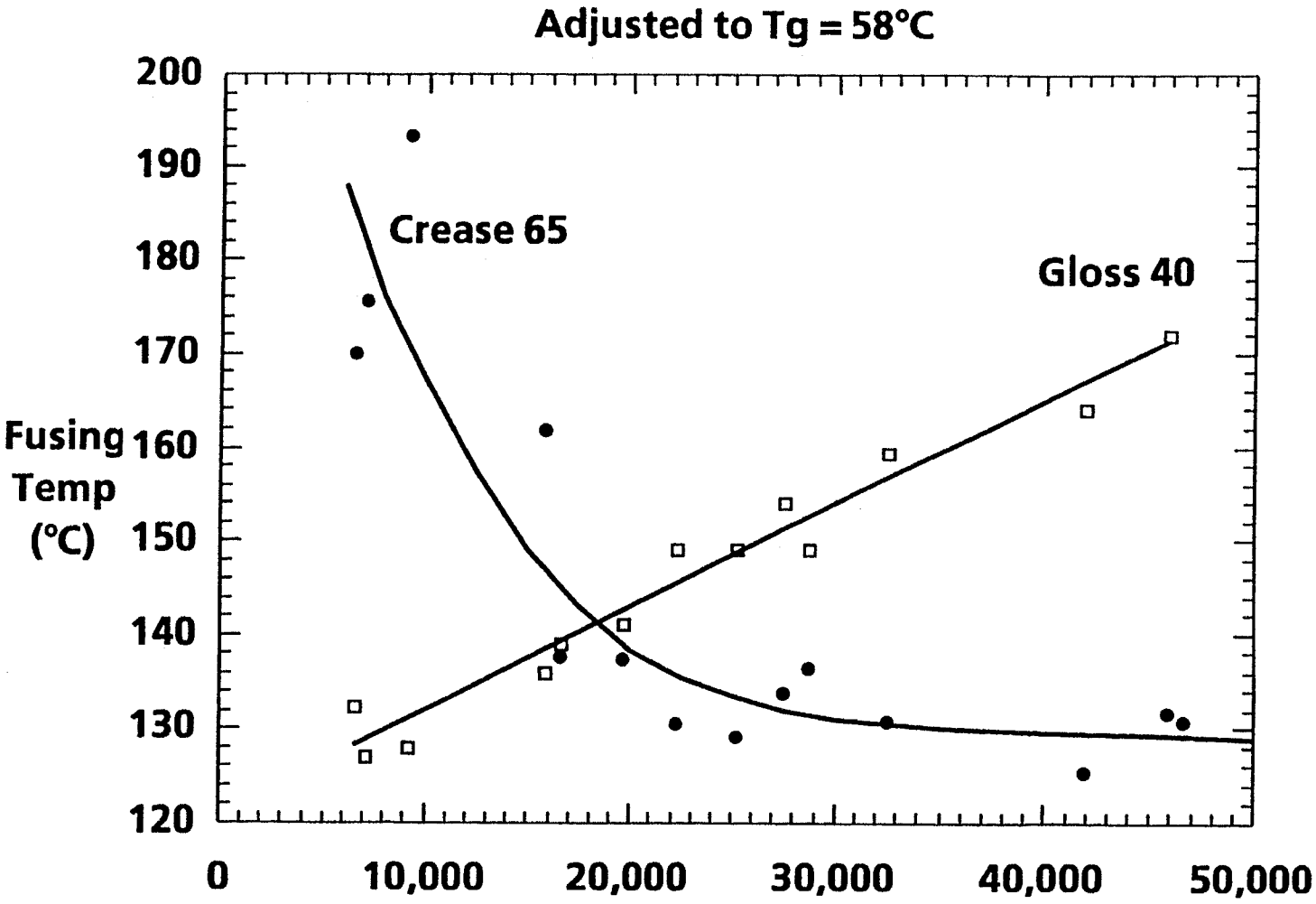
FIG. 1 shows the influence of molecular weight upon fix and gloss fusing properties.

The resin of the present invention is prepared by polymerizing styrene and n-butyl acrylate monomers.

The toners and resins of the present invention are characterized by specific physical properties. Specifically, the toners and resins of the present invention possess a low number average molecular weight (Mn), low weight average molecular weight (Mw), high molecular weight distribution (MWD) and a low glass transition temperature (Tg), which yield the beneficial properties of the disclosed toners and resins. Because the toners and resins of the present invention have comparable molecular weight properties, as evidenced by Table I below, the following discussion of these properties is in reference to the resin itself. One skilled in the art will recognize, however, that the molecular weight properties of the toner composition are comparable to those of the resin. These properties will now be discussed in more detail.

The resins of the present invention have an appropriate Mn in the range of under about 5,000, preferably about 1,000 to about 5,000. If the Mn is too low, of course, the glass transition temperature will be too low and the toner will be too soft resulting in toner blocking and poor mechanical properties. If the Mn is too high, the particles may not coalesce to each other or adhere well to the paper, or the resin may flow at a temperature which is too high for conventional applications. A Mn within the range of about 1,000 to about 5,000 yields a toner which provides a smooth glossy image for high gloss properties, and which also flows at a reasonable temperature. Preferably, the Mn of the resin should be within the range of from about 2,000 to about 4,000; and more preferably in the range of from about 2,100 to about 3,000.

Control of the weight average molecular weight also provides excellent fusing properties. At a given glass transition temperature, the weight average molecular weight is related to the fusing properties of the resin. This relationship appears to exist regardless of the molecular weight distribution of the resin. For example, FIG. 1 graphically depicts the influence of Mw on the fusing properties at an arbitrary glass transition temperature of 58° C. The graph shows the opposite behavior of the gloss and the fix properties as a function of Mw. As Mw increases at a constant Tg, the temperature at which a gloss level of 40 GU is obtained increases. Further, as Mw increases, the temperature at which a crease area of 65 is achieved decreases until a minimum is reached at a constant Tg. High gloss at a low temperature is achieved using a resin with a low Mw; whereas good fix at a low temperature is achieved using a resin with a high Mw. The cross-over point, at which the gloss and fix properties of a resin are maximized for the same fusing temperature, is at approximately Mw=19,000.

The Mw of the resins of the present invention is preferably within the range of from about 10,000 to about 40,000. For example, the Mw of the resins of the present invention may be within the range of from about 15,000 to about 35,000 or in the range of from about 20,000 to about 30,000.

The resins of the present invention also have a relatively high molecular weight distribution. Although the resin has a low number average molecular weight (Mn), it was found that providing some higher molecular weight polymer in the resin provides flexular strength to the resin and thus allows the toner particles to adhere more strongly to themselves and also to the paper fibers. The combination of a low Mn and a high MWD in the present invention enables the preparation of a toner resin which has both excellent gloss properties and good fix properties at the same low fusing temperature.

Preferably, the toner resins of the present invention have a MWD of greater than 6. More preferably, the MWD is in the range of from 6 to about 15, and even more preferably in the range of from about 7 to about 10. As an example, a resin with a MWD of 7.86 possesses excellent gloss, fix, and fusing temperature properties.

The above discussion describes the resins of the present invention in terms of the Mn, Mw and MWD values of the resins. However, it is noted that the three values are related by the formula MWD=Mw/Mn. Therefore, if any two values are known, the third value can be readily determined.

To facilitate the use of the resin in an electrostatographic toner, the resin should have a relatively low glass transition temperature (Tg). Preferred embodiments of the resins of the present invention have a Tg in the range of from about 50° C. to about 90° C. More preferably, the Tg of the resins is in the range of from about 50° C. to about 80° C.; and even more preferably the Tg is in the range of from about 50° C. to about 70° C.

The styrene/n-butyl acrylate copolymer resins of the present invention may be produced by a variety of polymerization methods know to the art. For example, the resins of the present invention may be produced by conventional solution polymerization or emulsion polymerization. The resins of the present invention may also advantageously be produced by a starve fed emulsion polymerization process, such as that disclosed in U.S. application Ser. No. 08/264,205, by Anthony J. Paine et al., filed concurrently herewith, the full disclosure of which is hereby incorporated by reference.

The portion of styrene present in the styrene/n-butyl acrylate copolymer resin is in a range of from about 60% to about 95% by weight. Preferably, the styrene is present in the resin in a range of from about 70% to about 90%; and more preferably in a range of from about 80% to about 88% by weight.

The portion of n-butyl acrylate present in the styrene/n-butyl acrylate copolymer resin is in a range of from about 5% to about 40% by weight. Preferably, the n-butyl acrylate is present in the resin in a range of from about 10% to about 30% by weight; and more preferably, in a range of from about 12% to about 20% by weight.

As an example, excellent gloss, fix and fusing temperature properties are achieved using a resin of the present invention containing about 88% styrene and about 12% n-butyl acrylate.

The resins of the present invention may be incorporated into toners, inks and developers by known methods.

The resins are generally present in the toner of the invention in an amount of from about 40% to about 98% by weight, and more preferably from about 70% to about 98% by weight, although they may be present in greater or lesser amounts, provided that the objectives of the invention are achieved. For example, toner resins of the invention can be subsequently melt blended or otherwise mixed with a colorant, charge control additives, surfactants, emulsifiers, pigment dispersants, flow additives, and the like. The resultant product can then be pulverized by known methods such as milling to form toner particles. The toner particles preferably have an average volume particle diameter of about 5 microns to about 25 microns, more preferably about 5 microns to about 15 microns.

Various suitable colorants can be employed in toners of the present invention, including suitable colored pigments, dyes, and mixtures thereof, including Carbon Black, such as Regal 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Cinquassi Green, Hostaperm Green, titanium dioxide, cobalt, nickel, iron powder, Sicopur 4068 FF, and iron oxides such as Mapico Black (Columbia), NP608 and NP604 (Northern Pigment), Bayferrox 8610 (Bayer), MO8699 (Mobay), TMB-100 (Magnox), mixtures thereof and the like.

The colorant, preferably carbon black, cyan, magenta and/or yellow colorant, is incorporated in an amount sufficient to impart the desired color to the toner. In general, pigment or dye is employed in an amount ranging from about 2% to about 60% by weight, and preferably from about 2% to about 15% by weight for color toner and about 5% to about 60% by weight for black toner.

Various known suitable effective positive or negative charge enhancing additives can be selected for incorporation into the toner compositions of the present invention, preferably in an amount of from about 0.1% to about 10% by weight, and more preferably from about 1% to about 3% by weight. Examples include quaternary ammonium compounds inclusive of alkyl pyridinium halides; alkyl pyridinium compounds, as disclosed in U.S. Pat. No. 4,298,672, the disclosure of which is totally incorporated herein by reference; organic sulfate and sulfonate compositions, as disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as Bontron E84™ or E88™ (Hodogaya Chemical); and the like.

Additionally, other internal and/or external additives may be added in known amounts for their known functions.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles which are positively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

The diameter of the carrier particles is generally from about 30 microns to about 1,000 microns, preferably from about 30 microns to about 150 microns, thus allowing these particles to possess sufficient density and inertia to avoid adherence to the electrostatic images during the development process. The carrier particles can be mixed with the toner particles in various suitable combinations. The toner concentration is usually about 2% to about 10% by weight of toner and about 90% to about 98% by weight of carrier. However, one skilled in the art will recognize that different toner and carrier percentages may be used to achieve a developer composition with desired characteristics.

Toners of the present invention can be used in known electrostatographic imaging methods, although the fusing energy requirements of some of those methods can be reduced in view of the advantageous fusing properties of the toner of the invention as discussed herein. Thus for example, the toners or developers of the invention can be charged, e.g., triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

Toners incorporating resins of the present invention have characteristic fusing temperatures which are required to reach a level of 50 gloss units (GU) and a crease area of 65 using the crease test. These values are denoted $T_{G50}$ and $T_{C65}$, respectively. Preferable toners of the present invention have a $T_{G50}$ value below about 150° C. As an example, good results are obtained with a toner having $T_{G50}$ of 144° C.

Preferable toners of the present invention have a $T_{C65}$ value below about 170° C. Preferred are toners wherein $T_{C65}$ is below about 150° C. As an example, good results are obtained with a toner having $T_{C65}$ of 132° C.

One skilled in the art will recognize that the above resin characteristics and monomer ratios may be adjusted as necessary to achieve a resin with specific characteristics. The following examples illustrate specific embodiments of this invention, but do not limit the scope of the present invention. Parts and percentages are by weight unless otherwise indicated.

EXAMPLES

Example 1

An emulsion polymerized copolymer is prepared using the following procedure. Into a 500 milliliter polypropylene bottle are added 264 grams styrene monomer (Fluka), 36 grams n-butyl acrylate monomer (Aldrich), 6 grams acrylic acid (Aldrich) and 30.0 grams 1-dodecanethiol (Aldrich). The monomer solution is 88 percent styrene and 12 percent n-butyl acrylate. In a separate 500 milliliter polypropylene bottle is added 4.5 grams sodium dodecyl benzene sulphonate (Fluka), 7.5 grams potassium persulphate (Fluka) and 450 milliliters of distilled water. A 2 liter glass reactor kettle equipped with a mechanical stirrer and a nitrogen purging line is placed in an oil bath preheated to 70° C. The monomer solution is added to the aqueous solution and then all of the material is poured into the reactor kettle and the stirrer is turned on to rotate at approximately 190 rpm. The polymerization of the monomers in the aqueous phase via emulsion polymerization is continued for 20 hours.

After polymerization, the emulsion copolymer is dissolved into toluene and centrifuged. The toluene layer is decanted and dried over sodium sulphate, filtered through a "M" type of filter and then precipitated into methanol to produce a white polymer solid. The molecular weight properties of the polymer are measured on a Hewlett Packard GPC (gel permeation chromatography) instrument equipped with a 1090 Liquid Chromatograph and a refractive index detector. The number average molecular weight is calculated based on a polystyrene calibration curve. The number average molecular weight distribution is 2,156, the weight average molecular weight is 16,955 and the molecular weight distribution is 7.86 for the resin.

The styrene/n-butyl acrylate copolymer resin is made into conventional toner by melt mixing the resin with 2 percent PV Fast Blue pigment (Hoechst) and then extruding the pigmented resin into toner-size particles. The glass transition temperature of the toner is measured at 20° C./min to be 54.9° C. for the midpoint Tg. The molecular weight values of the toner are measured to be Mn=2,640, Mw=19,652 and MWD=7.44.

A developer composition is prepared by roll milling 3 parts by weight of the above-prepared toner with 97 parts by weight of a carrier for one hour. The carrier used in this example comprises a steel core with a 1.25% by weight coating of polyvinylidene polymer. The result is a developer composition having a toner concentration of 3.0%. Unfused copies are produced on Hammermill laser print paper using a Xerox Corporation 1075® imaging apparatus with the fusing system disabled. These unfused images are subsequently fused on a fusing fixture giving the fusing properties as summarized in Tables I and II.

Comparative Example 1

A solution polymerized copolymer is prepared using the following procedure. Into a 500 milliliter polypropylene bottle are added 264 grams styrene monomer (Fluka), 36 grams n-butyl acrylate monomer (Aldrich), 6 grams acrylic acid (Aldrich), 5.7 grams 1-dodecanethiol (Aldrich), 4.5 grams 2,2'-azobis(2,4dimethylvaleronitrile) (Polysciences Inc.) and 4.5 grams 2,2'-azobis( 2-methylbutyronitrile) (Polysciences Inc.). This solution is rotated on a roll mill to dissolve the initiators into the monomer solution. The monomer solution is 88 percent styrene and 12 percent n-butyl acrylate. Into a 2 liter glass temperature-controlled reactor kettle equipped with a mechanical stirrer and a temperature probe, are added 450 milliliters of toluene (Caledon). The toluene is heated at a rate of 1° C./min from room temperature to 80° C. for approximately one hour. Once the solvent reaches 80° C., the monomer and dissolved initiator solution is added and the mixture is polymerized at 80° C. for a total of 1,500 minutes (25 hours).

After polymerization, the solution copolymer is precipitated into methanol, isolated and dried. The molecular weight properties of the polymer are measured on a Hewlett Packard GPC (gel permeation chromatography) instrument equipped with a 1090 Liquid Chromatograph and a refractive index detector. The molecular weight is calculated based on a polystyrene calibration curve. The number average molecular weight is 2,255, the weight average molecular weight is 7,941 and the molecular weight distribution is 3.52 for the resin.

The styrene/n-butyl acrylate copolymer resin is made into conventional toner by melt mixing the resin with 2 percent PV Fast Blue pigment (Hoechst) and then extruding the pigmented resin into toner-size particles. The glass transition temperature of the toner is measured at 20° C./min to be 65.0° C. for the midpoint Tg. The molecular weight values of the toner are measured to be Mn=1,883, Mw=7,130 and MWD=3.79. The toner is made into a developer, imaged and fused on a fusing fixture as in Example 1, giving the fusing properties as summarized in Tables I and II.

Comparative Example 2

A solution polymerized copolymer is prepared using the following procedure. Into a 500 milliliter polypropylene bottle are added 246 grams styrene monomer (Fluka), 48 grams n-butyl acrylate monomer (Aldrich), 6 grams acrylic acid (Aldrich) and 22.5 grams benzoyl peroxide (Aldrich). This solution is rotated on a roll mill to dissolve the initiators into the monomer solution. The monomer solution is 84 percent styrene and 16 percent n-butyl acrylate. Into a 2 liter glass temperature-controlled reactor kettle equipped with a mechanical stirrer and a temperature probe, are added 600 milliliters of toluene (Caledon) and the monomer solution. The solution is heated at a rate of 1° C./min from room temperature to 95° C. and maintained at 95° C. for 780 minutes, during which time the polymerization occurs.

After polymerization, the solution copolymer is precipitated into methanol, isolated and dried. The molecular weight properties of the polymer are measured on a Hewlett Packard GPC (gel permeation chromatography) instrument equipped with a 1090 Liquid Chromatograph and a refractive index detector. The molecular weight is calculated based on a polystyrene calibration curve. The number average molecular weight is 2,133, the weight average molecular weight is 6,176 and the molecular weight distribution is 2.90 for the resin.

The styrene/n-butyl acrylate copolymer resin is made into conventional toner by melt mixing the resin with 2 percent PV Fast Blue pigment (Hoechst) and then extruding the pigmented resin into toner-size particles. The glass transition temperature of the toner is measured at 20° C./min to be 68.5° C. for the midpoint $T_g$. The molecular weight values of the toner are measured to be Mn=2,257, Mw=6,515 and MWD=2.89. The toner is made into a developer, imaged and fused on a fusing fixture as in Example 1, giving the fusing properties as summarized in Tables I and II.

Comparative Example 3

A solution polymerized copolymer is prepared using the following procedure. Into a 500 milliliter polypropylene bottle are added 264 grams styrene monomer (Fluka), 36 grams n-butyl acrylate monomer (Aldrich), 6 grams acrylic acid (Aldrich), 1.3 grams, 1-dodecanethiol (Aldrich), 0.675 grams benzoyl peroxide (Aldrich) and 0.45 grams 2,2'-azobis(2-methylbutyronitrile) (Polysciences Inc.). This solution is rotated on a roll mill to dissolve the initiators into the monomer solution. The monomer solution is 88 percent styrene and 12 percent n-butyl acrylate. Into a 2 liter glass temperature-controlled reactor kettle equipped with a mechanical stirrer and a temperature probe, are added 450 milliliters of toluene (Caledon) and the monomer solution. The solution is heated at a rate of 1° C./min from room temperature to 80° C. and maintained at 80° C. for 25 hours, during which time the polymerization occurs.

After polymerization, the solution copolymer is precipitated into methanol, isolated and dried. The molecular weight properties of the polymer are measured on a Hewlett Packard GPC (gel permeation chromatography) instrument equipped with a 1090 Liquid Chromatograph and a refractive index detector. The molecular weight is calculated based on a polystyrene calibration curve. The number average molecular weight is 7,720, the weight average molecular weight is 43,675 and the molecular weight distribution is 5.66 for the resin.

The styrene/n-butyl acrylate copolymer resin is made into conventional toner by melt mixing the resin with 2 percent PV Fast Blue pigment (Hoechst) and then extruding the pigmented resin into toner-size particles. The glass transition temperature of the toner is measured at 20° C./min to be 91.3° C. for the midpoint Tg. The molecular weight values of the toner are measured to be Mn=8,521, Mw=46,616 and MWD=5.47. The toner is made into a developer, imaged and fused on a fusing fixture as in Example 1, giving the fusing properties as summarized in Tables I and II.

Comparative Example 4

As a comparative example, the same tests and measurements are performed using a cyan Nippon Carbide emulsion/aggregation toner, identified by Nippon Carbide as NCHTCO41C. The Nippon Carbide toner is made into a developer, imaged and fused on a fusing fixture as in Example 1, above. The results and measurements of the comparative toner are included in Tables I and II.

Comparative Example 5

As a further comparative example, the same tests and measurements are made on a polyester toner except for molecular weight analysis. The results and measurements of the comparative toner are included in Tables I and II.

TABLE 1

Molecular Properties of Resins and Toners

| Example # | Wt % Styrene | Tg (°C.) | Mn[1] | Mw[1] | MWD[1] |
|---|---|---|---|---|---|
| 1 | 84 | 54.9 | R = 2156 | R = 16955 | R = 7.86 |
| | | | T = 2640 | T = 19652 | T = 7.44 |
| Comp 1 | 88 | 65.0 | R = 2255 | R = 7941 | R = 3.52 |
| | | | T = 1883 | T = 7130 | T = 3.79 |
| Comp 2 | 84 | 68.5 | R = 2133 | R = 6176 | R = 2.90 |
| | | | T = 2257 | T = 6515 | T = 2.89 |
| Comp 3 | 88 | 91.3 | R = 7720 | R = 43675 | R = 5.66 |
| | | | T = 8521 | T = 46616 | T = 5.47 |
| Comp 4 | 88 | 65.8 | T = 3336 | T = 19776 | T = 5.93 |
| Comp 5 | NA[2] | | | | |

NOTE:

TABLE 1-continued

| Molecular Properties of Resins and Toners | | | | | |
|---|---|---|---|---|---|
| Example # | Wt % Styrene | Tg (°C.) | Mn[1] | Mw[1] | MWD[1] |

Data for Comparative Example 5 is omitted from Table 1 above because the toner of Comparative Example 5 is a polyester resin, and therefore does not contain styrene. Also, the molecular weight data cannot be measured using the same conditions and instruments, and is therefore unavailable.
[1]The labels "R =" and "T =" indicate the molecular weight property of the resin and toner, respectively.
[2]Not applicable - this is a polyester resin.

Analysis of Comparative Examples

Comparative Examples 1 and 2 illustrate resins which have low Mn, Mw and MWD. Although both Examples have excellent gloss properties, as shown in Table II, they possess poor fix properties. The low molecular weight of the polymer resin enables the polymer chains to flow at low fusing temperatures and produce a very smooth glossy surface resulting in high image gloss. Unfortunately, the fixing temperature is too high. The fix properties (as measured by the crease test) produce an image that has many cracks emanating from the center fold of the crease. This behavior is characteristic of brittle toners. The mechanical properties of the resin are poor, and thus the flexural strength of the fused image is low. This is due to a lack of polymer chain entanglement or weak entanglement of the low molecular weight chains. The toner flows well into the paper, but the strength of the toner image is poor resulting in cracks throughout the crease. Thus the low molecular weight properties achieve high gloss but yield poor fix behavior. The fusing temperatures of the Examples are included in Table II.

Comparative Example 3, on the contrary, demonstrates the effects of Mn and Mw being too high. Comparative Example 3 demonstrates fix behavior similar to that of Comparative Examples 1 and 2, but also yields poor gloss properties. High gloss images can only be achieved using the resin of Comparative Example 3 at very high fusing temperatures, as shown in Table II. A gloss level of 50 GU is not achieved even when the temperature is increased up to 200° C. The higher molecular weight polymer decreases the gloss properties, as also shown by the high Tg of the resin. The high Mn and Mw of the toner, yielding the higher MWD, produces a resin that has a high melt viscosity which prevents the toner particles from coalescing with each other and prevents the toner from flowing into the paper fibers. The crease test shows a clean break in the toner image with no cracks emanating out from the center of the crease.

Example 1, however, demonstrates a toner resin of the claimed invention which possesses both the desirable fix and gloss properties. The low Mn of the resin enables the resin to flow at a reasonable temperature and provide a smooth glossy image for high gloss properties. The resin also has some high molecular weight polymer, as evidenced by the higher MWD, which provides elastic strength to the resin and enables the toner image to adhere strongly to itself and to the paper fibers. Thus the combination of low Mn and high MWD provides the resins of the present invention which have both high gloss and good fix at low fusing temperatures.

Comparative Examples 4 and 5 are included as reference toners to enable comparison of the toners of the present inventions to other toners. The toner of Comparative Example 4, although having molecular weight values similar to those of toners of the present invention, possesses a much higher fusing temperature (176° C.). Comparative Example 4 thus also shows the interrelation of the molecular weight properties. Although the Mn and Mw are in the desired range to produce good gloss properties, they yield a MWD which is too low for good fix properties.

Comparative Example 5 is a conventional polyester resin-based toner, used for comparison purposes. As demonstrated above, the styrene/n-butyl acrylate copolymer toner resins of the present invention yield high gloss and good fix properties comparable to the polyester based resin. Such comparable results were believed by the toner/developer community to be unattainable with styrene/n-butyl acrylate toner resins.

TABLE II

| Fusing Properties of Toners | | | | | | | |
|---|---|---|---|---|---|---|---|
| | Gloss Temperature, °C. | | | Hot Offset Temperature | Gloss Latitude[1] | $T_{C65}$ | Fix Latitude |
| Example # | $T_{G50}$ | $T_{G60}$ | $T_{G70}$ | °C. | °C. | °C. | °C. |
| 1 | 144 | 148 | 154 | >200 | >56 | 132 | >68 |
| Comp 1 | 133 | 138 | 143 | 190 | 57 | 181 | 9 |
| Comp 2 | 134 | 139 | 145 | 190 | 56 | 181 | 9 |
| Comp 3 | NR[2] | NR[2] | NR[2] | >200 | 0 | 175 | >25 |
| Comp 4 | 139 | 145 | 148 | 200 | 61 | 176 | 27 |
| Comp 5[3] | 138 | 142 | 147 | 200 | 62 | 138 | 60 |

[1]Gloss latitude = Hot Offset Temperature - $T_{G50}$
[2]NR means that the value is not reached because the temperature is too high.
[3]The data for the polyester-based resin toner is accurate to +/− 2° C., as found over several test runs.
$T_{G50}$ = Fusing temperature required to reach gloss of 50 GU
$T_{G60}$ = Fusing temperature required to reach gloss of 60 GU
$T_{G70}$ = Fusing temperature required to reach gloss of 70 GU
$T_{C65}$ = Fusing temperature required to reach crease area of 65 CA
Fix Latitude = Hot Offset Temperature - $T_{C65}$

What is claimed is:

1. A toner composition comprising a monomodal styrene butyl acrylate polymer resin and a colorant, wherein said toner resin has a number average molecular weight of from about 1,000 to about 5,000, a weight average molecular weight of from about 10,000 to about 40,000 and a molecular weight distribution of greater than 6.

2. A toner composition according to claim 1, wherein said number average molecular weight is from about 1,000 to about 5,000 and said weight average molecular weight is from about 15,000 to about 35,000.

3. A toner composition according to claim 1, wherein said molecular weight distribution is from 6 to about 15.

4. A toner composition according to claim 1, wherein said resin has a glass transition temperature of from about 50° C. to about 90° C.

5. A toner composition according to claim 1, wherein said resin contains from about 60% to about 95% by weight of styrene and from about 5% to about 40% by weight of n-butyl acrylate.

6. A toner composition according to claim 1, wherein said resin contains from about 80% to about 88% by weight of styrene and from about 12% to about 20% by weight of n-butyl acrylate.

7. A toner composition according to claim 1, wherein said colorant comprises carbon black.

8. A toner composition according to claim 1, wherein said colorant comprises magnetite.

9. A toner composition according to claim 1, wherein said colorant is selected from the group of cyan, magenta or yellow colorants.

10. A toner composition according to claim 1, further comprising a charge enhancing additive.

11. A toner composition according to claim 1, further comprising a flow enhancing additive.

12. A styrene/n-butyl acrylate copolymer resin composition wherein said resin is monomodal and has a number average molecular weight of from about 1,000 to about 5,000, a weight average molecular weight of from about 10,000 to about 40,000 and a molecular weight distribution of greater than 6.

13. A resin according to claim 12, wherein said number average molecular weight is from about 1,000 to about 5,000 and said weight average molecular weight is from about 15,000 to about 35,000.

14. A resin according to claim 12, wherein said molecular weight distribution is from 6 to about 15.

15. A resin according to claim 12, wherein said resin has a glass transition temperature of from about 50° C. to about 90° C.

16. A resin according to claim 12, wherein said resin contains from about 60% to about 95% by weight of styrene and from about 5% to about 40% by weight of n-butyl acrylate.

17. A resin according to claim 12, wherein said resin contains from about 80% to about 88% by weight of styrene and from about 12% to about 20% by weight of n-butyl acrylate.

* * * * *